US007779533B2

(12) United States Patent
Peter et al.

(10) Patent No.: US 7,779,533 B2
(45) Date of Patent: Aug. 24, 2010

(54) ELECTRONIC ARTICLE SURVEILLANCE MARKER

(75) Inventors: Johannes Maxmillian Peter, Overland Park, KS (US); Mark Thomas Hibshman, Sugar Grove, IL (US); Mark Charles Volz, Overland Park, KS (US); Raymond Dean Newton, Topeka, KS (US)

(73) Assignee: Phenix Label Company, Inc., Olathe, KS (US)

( * ) Notice: Subject to any disclaimer, the term of this patent is extended or adjusted under 35 U.S.C. 154(b) by 121 days.

(21) Appl. No.: 12/008,739

(22) Filed: Jan. 14, 2008

(65) Prior Publication Data

US 2008/0136571 A1 Jun. 12, 2008

Related U.S. Application Data

(63) Continuation-in-part of application No. 12/008,734, filed on Jan. 14, 2008, which is a continuation-in-part of application No. 11/981,999, filed on Oct. 31, 2007, which is a continuation-in-part of application No. 11/705,946, filed on Feb. 14, 2007.

(60) Provisional application No. 60/773,763, filed on Feb. 15, 2006.

(51) Int. Cl.
*H01P 11/00* (2006.01)
*H01Q 13/00* (2006.01)

(52) U.S. Cl. ..... 29/600; 29/594; 29/593; 29/603.01; 340/552; 340/561; 343/787; 148/311; 148/313; 361/143; 156/199; 156/209; 156/256; 156/301

(58) Field of Classification Search ..... 29/594, 29/593, 600, 603.01, 607, 609; 340/551, 340/552, 561, 572; 343/787; 148/311, 313; 361/143, 149, 147, 148, 152; 156/199, 209, 156/256, 301
See application file for complete search history.

(56) References Cited

U.S. PATENT DOCUMENTS

| | | | | |
|---|---|---|---|---|
| 4,510,489 | A | 4/1985 | Anderson, III et al. | 340/572.1 |
| 4,510,490 | A | 4/1985 | Anderson, III et al. | 340/572.1 |
| 5,469,140 | A | 11/1995 | Liu et al. | 340/551 |
| 5,495,230 | A * | 2/1996 | Lian | 340/572.1 |
| 5,653,824 | A | 8/1997 | Manning et al. | 148/306 |
| 5,729,200 | A | 3/1998 | Copeland et al. | 340/551 |
| 5,949,318 | A | 9/1999 | Copeland et al. | 335/306 |

(Continued)

*Primary Examiner*—Derris H Banks
*Assistant Examiner*—Jeffrey Carley
(74) *Attorney, Agent, or Firm*—Ernest D. Buff & Associates, LLC; Ernest D. Buff; Gordon E. Fish

(57) ABSTRACT

A fabrication process produces markers for a magnetomechanical electronic article surveillance system. The marker includes a magnetomechanical element comprising one or more resonator strips of magnetostrictive amorphous metal alloy; a housing having a cavity sized and shaped to accommodate the resonator strips for free mechanical vibration therewithin; and a non-deactivatable bias magnet adapted to magnetically bias the magnetomechanical element. The process employs adaptive control of the cut length of the resonator strips, correction of the length being based on deviation of the actual marker resonant frequency from a preselected, target marker frequency. Use of adaptive, feedback control advantageously results in a much tighter distribution of actual resonant frequencies. Also provided is a web-fed press for continuously producing such markers with adaptive control of the resonator strip length.

13 Claims, 4 Drawing Sheets

U.S. PATENT DOCUMENTS

| | | | | |
|---|---|---|---|---|
| 5,949,334 | A | 9/1999 | Lian et al. | 340/572.1 |
| 6,020,817 | A | 2/2000 | Copeland et al. | 340/551 |
| 6,096,153 | A * | 8/2000 | Nowaczyk | 156/199 |
| 6,181,245 | B1 | 1/2001 | Copeland et al. | 340/551 |
| 6,182,352 | B1 * | 2/2001 | Deschenes et al. | 29/602.1 |
| 6,359,563 | B1 | 3/2002 | Herzer | 340/572.6 |
| 6,371,187 | B1 | 4/2002 | Nowaczyk | 156/511 |
| 6,395,373 | B2 | 5/2002 | Conti et al. | 428/138 |
| 6,647,844 | B1 | 11/2003 | Nowaczyk | 83/134 |
| 6,692,672 | B1 | 2/2004 | Deschenes et al. | 264/151 |
| 2003/0020612 | A1 * | 1/2003 | Lian et al. | 340/572.6 |
| 2006/0220849 | A1 * | 10/2006 | Hasegawa et al. | 340/568.1 |
| 2008/0030339 | A1 * | 2/2008 | Gadonniex et al. | 340/572.6 |

* cited by examiner

ELECTRONIC ARTICLE SURVEILLANCE MARKER

RELATED U.S. APPLICATION DATA

This application is a continuation-in-part of co-pending U.S. application Ser. No. 12/008,734, filed Jan. 14, 2008, which, in turn, is a continuation-in-part of U.S. application Ser. No. 11/981,999, filed Oct. 31, 2007 which, in turn, is a continuation-in-part of U.S. application Ser. No. 11/705,946, filed Feb. 14, 2007, and further claims the benefit of U.S. Provisional Application Ser. No. 60/773,763, filed Feb. 15, 2006, entitled "Electronic Article Surveillance Marker," which applications are incorporated herein in their entirety by reference thereto.

BACKGROUND OF THE INVENTION

1. Field of the Invention

The present invention relates to an electronic article surveillance system and a non-deactivatable marker for use therein; and more particularly, to a process for fabricating a magnetomechanically resonant, non-deactivtable marker with improved control of the resonant frequency of the marker that enhances the sensitivity and reliability of the article surveillance system.

2. Description of the Prior Art

Attempts to protect articles of merchandise and the like against theft from retail stores have resulted in numerous technical arrangements, often termed electronic article surveillance (EAS). Many of the forms of protection employ a tag or marker secured to articles for which protection is sought. The marker responds to an electromagnetic interrogation signal from transmitting apparatus situated proximate either an exit door of the premises to be protected, or an aisleway adjacent to the cashier or checkout station. A nearby receiving apparatus receives a signal produced by the marker in response to the interrogation signal. The presence of the response signal indicates that the marker has not been removed or deactivated by the cashier, and that the article bearing it may not have been paid for or properly checked out.

One common type of EAS system typically known as a harmonic (or electromagnetic) system relies on a marker comprising a first elongated element of high magnetic permeability ferromagnetic material, which is optionally disposed adjacent to at least a second element of ferromagnetic material having higher coercivity than the first element. When subjected to a low-amplitude electromagnetic field having an interrogation frequency, the marker causes harmonics of the interrogation frequency to be developed in a receiving coil. The detection of such harmonics indicates the presence of the marker. A marker having the second element may be deactivated by changing the state of magnetization of the second element, typically by exposing it to a dc magnetic field strong enough to appreciably saturate the second element. Depending upon the design of the marker and detection system, either the amplitude of the harmonics chosen for detection is significantly reduced, or the amplitude of the even numbered harmonics is significantly changed. Either of these changes can be readily detected in the receiving coil. In practice, harmonic EAS systems encounter a number of problems. A principal difficulty stems from the superposition of the harmonic signal and the far more intense signal at the fundamental interrogation frequency. The detection electronics must be responsive to the relatively weak harmonic signal and discriminate it from the carrier signal and other ambient electronic noise. Harmonic systems are also known to be vulnerable to false alarms arising from massive ferrous objects (such as shopping carts) also present in a typical retail environment.

Another type of EAS marker and system (known as magnetomechanical or magnetoacoustic) is disclosed by U.S. Pat. Nos. 4,510,489 and 4,510,490 ("the '489 and '490 patents"), both to Anderson et al., which are both incorporated herein in the entirety by reference thereto. The marker comprises an elongated, ductile strip of magnetostrictive ferromagnetic material adapted to be magnetically biased and thereby armed to resonate mechanically at a frequency within the frequency band of an incident magnetic field. A hard ferromagnetic element, disposed adjacent to the strip of magnetostrictive material, is adapted, upon being magnetized, to arm the strip to resonate at that frequency. The resonance condition is established by the equation:

$$f_r=(1/2L)(E/\delta)^{1/2} \quad (1)$$

wherein $f_r$ is the resonant frequency for an elongated ribbon sample having length L, and E and δ are the Young's modulus and mass density of the ribbon, respectively.

The resonance causes the marker to respond to an ac electromagnetic field by changes in its mechanical and magnetic properties, notably including changes in its effective magnetic permeability. In the presence of a biasing dc magnetic field the effective magnetic permeability of the marker for excitation by an applied ac electromagnetic field is strongly dependent on frequency. That is to say, the effective permeability of the marker is substantially different for excitation by an ac field having a frequency approximately equal to either the resonant or anti-resonant frequency than for excitation at other frequencies. Exposing the resonant element to an external ac field urges it to vibration, with a coupling that may be characterized by the marker's magnetomechanical coupling factor, k, greater than 0, given by the formula:

$$k=[1-(f_r/f_a)^2]^{1/2}, \quad (2)$$

wherein $f_r$ and $f_a$ are the resonant and anti-resonant frequencies of the magnetostrictive element, respectively. A detecting means detects the change in coupling between the interrogating and receiving coils at the resonant and/or anti-resonant frequency, and distinguishes it from changes in coupling at other than those frequencies. The coupling is especially strong for excitation at the natural resonant frequency. It is further known, e.g. from U.S. Pat. No. 5,495,230 to Lian, that the resonant frequency depends strongly on the magnitude of the biasing field imposed on the resonant element as a consequence of the bias-field dependence of Young's modulus E in the foregoing resonance equation.

A marker of the type disclosed by the '489 patent is depicted generally at 11 by FIG. 1. Marker 12 comprises a strip 14 disposed adjacent to a ferromagnetic element 16, such as a biasing magnet capable of applying a dc field to strip 14. The composite assembly is then placed within the hollow recess 17 of a rigid container 18 composed of polymeric material such as polyethylene or the like, to protect the assembly against mechanical damping. The biasing magnet 16 is typically a flat strip of magnetic material such as SAE 1095 steel, Vicalloy, Remalloy or Arnokrome. Magnetomechanical EAS systems in which it is desirable to deactivate the marker in the field usually employ semi-hard magnetic materials for the bias element.

The '489 patent also discloses a pulsed EAS system in which a transmitter drives a transmitting antenna, such as a coil, that produces a pulsed electromagnetic field having an interrogation frequency. If present within the antenna field, an active marker having a resonance frequency equal to the interrogation frequency is driven into magnetomechanical resonance. During the interval between transmitted pulses, the excited marker continues to vibrate mechanically at its resonant frequency, thereby producing a magnetic field oscillating at the resonant frequency. The amplitude of the mechanical vibration and the resulting magnetic field decrease exponentially with time. This damped resonance thereby provides the marker with one form of characteristic signal identity.

A similar EAS marker disclosed by the '490 patent comprises multiple strips disposed in a side-by-side fashion. The strips have different resonant frequencies, permitting the marker to be coded by selecting particular frequencies. The coding is detected by ascertaining the multiple frequencies at which the '490 tag exhibits resonance.

However, known magnetomechanically resonant markers comprising magnetostrictive material and systems employing such markers, including those of the types disclosed by the '489 and '490 patents, have a number of characteristics that render them undesirable for certain applications. The markers are relatively large in size, in both their length and width directions. As a result, they are too large to be accommodated on some items of merchandise, including many for which protection is highly desirable because of their high value. A large marker is also relatively conspicuous when affixed externally to a merchandise item. Attempts to reduce the size of the marker encounter certain obstacles. In general, reducing the volume of the resonating magnetic element proportionally reduces the detectable signal from the marker and the size of the interrogation zone within which the marker is responsive, hindering reliable detection. For example, in a retail environment, it is a practical necessity that reliable detection be possible over the full aisle width at the store's exit.

Another form of magnetoacoustic EAS marker is provided by U.S. Pat. No. 6,359,563 to Herzer. The '563 marker employs multiple strips of magnetostrictive amorphous ribbon that are cut to the same length and given the same annealing treatment. A marker having such strips disposed in registration is disclosed to produce a resonant signal amplitude that is comparable to that produced by a conventional magnetoelastic marker employing a single piece of material having about twice the width. On the other hand, a single strip of thicker ribbon, even after annealing, is disclosed not to provide a commensurate increase in resonant signal amplitude.

The '563 patent further discloses that prior art ribbon optimized for a multiple resonator tag is unsuitable for a single resonator marker and vice versa. Moreover, each of the multiple strip markers disclosed by the '563 reference employs an annealed ribbon, and not as-cast, unannealed material. A feedback controlled annealing system is said to provide extremely consistent and reproducible properties in the annealed ribbon, which otherwise is said to be subject to relatively strong fluctuations in the required magnetic properties.

There exists a need in the market place for an Accousto Magnetic label that is compatible with standard 58 Khz EAS systems; but does not deactivate or deaden during purchase of merchandise with which the label is associated. Currently retailers are using a "hard tag" that is attached to an article appointed for protection. The label is detached at the register. Contained within the "hard tag" is a ferrite adapted to trigger an alarm of an EAS system when an article is improperly taken out of the store. These deactivatable, ferrite containing tags are expensive. Application of non-deactivatable Accousto Magnetic "hard tags" to merchandise for which protection is sought would eliminate use of ferrites and save considerable costs.

There remains a need in the art for a non-deactivatable, mechanically resonant EAS marker that is inexpensive to produce, and highly reliable in operation. Also needed is a method and apparatus that produces non-deactivatable, mechanically resonant EAS markers with such precision that signals repeatedly generated by the markers in the presence of an applied magnetic field have substantially the same identifying characteristics.

SUMMARY OF THE INVENTION

In one aspect, the present invention provides a magnetomechanical marker and an electronic article surveillance system using a non-deactivatable marker. The marker is exceedingly robust, inexpensive to produce and highly reliable in operation. It exhibits magnetomechanical resonance at a marker resonant frequency in response to the incidence thereon of an electromagnetic interrogating field. The marker comprises: (i) a magnetomechanical element comprising at least one, and preferably two or more, elongated resonator strips composed of unannealed magnetostrictive amorphous metal alloy; (ii) a housing having a cavity sized and shaped to accommodate the magnetomechanical element, the one or more resonator strips being disposed in the cavity and able to mechanically vibrate freely therewithin; and (iii) a bias element, such as a strip of semi-hard magnetic metal alloy, that highly resists deactivation, and is adapted to be magnetized to magnetically bias the magnetomechanical element, whereby the magnetomechanical element is armed to resonate at the marker resonant frequency in the presence of an electromagnetic interrogating field. A plurality of resonator strips, when used to comprise the magnetomechanical element, are disposed in the cavity in stacked registration. In some embodiments, these resonator strips are of substantially the same length so that they resonate at substantially the same frequency. Other embodiments employ plural strips having a plurality of preselected resonant frequencies to provide a coded marker, such as a marker of the type disclosed by the '490 patent.

Further provided are a process and apparatus for continuously fabricating a sequence of such markers for a magnetomechanical electronic article surveillance system. The process preferably employs a measurement of marker resonant frequency of the markers during the fabrication and adaptive control of the cut length of resonator strips that are incorporated in markers subsequently produced in the sequence.

In one implementation of the process, each marker comprises: (i) a magnetomechanical element comprising at least one elongated resonator strip having a resonator strip cut length; (ii) a bias element adapted to magnetically bias the magnetomechanical element, whereby the magnetomechanical element is armed to resonate at a marker resonant frequency; and (iii) a housing having a cavity sized and shaped to accommodate the magnetomechanical element and permit it to mechanically vibrate freely therewithin. The process comprises: (a) forming a plurality of cavities along a web of cavity stock, each of the cavities having a substantially rectangular, prismatic shape open on a large side and a lip extending substantially around the periphery of the opening of the cavity; (b) cutting elongated resonator strips sequentially from a supply of magnetostrictive amorphous metal alloy using a resonator strip cutting system, the resonator strips having a resonator strip cut length; (c) extracting at least one of the resonator strips from the cutter system using an extractor; (d) disposing at least one of the resonator strips in each of the cavities to provide a magnetomechanical element of the marker; (e) affixing a lid to the lip to close the cavity and contain the magnetomechanical element therewithin; (f) supplying bias elements from a supply of semi-hard magnetic material, the bias strips having a bias shape and bias dimensions; (g) fixedly disposing a bias element on the lid in registration with the magnetomechanical element; (h) optionally activating at least a portion of the markers by magnetizing the bias elements, whereby the markers are armed to resonate at the marker resonant frequency; (i) measuring the resonant frequency of each of the markers in a preselected sample portion of the sequence; and (j) adaptively controlling the resonator strip cut length for resonator strips incorporated in subsequently produced markers of the sequence, the resonator strip cut length being adjusted to an updated resonator strip cut length determined from a difference between the measured marker resonant frequencies and a preselected target resonant frequency, whereby the difference for the subsequently produced markers is reduced. Steps (i) and (j) are repeated during the course of the fabrication. Optionally, the web is cut to separate the markers and the markers are adhered to a release liner.

As a result of the foregoing adaptive control, based on measurement of the resonant frequencies of finished markers during the production, the sequence exhibits a tight distribution of frequencies, improving the production yield of markers and the reliability of EAS system operation. Moreover, the control permits industrially viable construction of markers wherein the magnetostrictive element comprises plural strips of unannealed, magnetostrictive amorphous metal alloy. Such markers are smaller and are more easily and reliably produced than previous markers, which have required either a larger footprint or use of annealed magnetic materials.

There is further provided a press for fabricating a sequence of magnetomechanical EAS markers, such as markers of the foregoing construction. The press comprises: (a) a web infeed system for delivering a continuous web of cavity stock; (b) a cavity formation die set for forming a plurality of cavities along the web, each of the cavities having a substantially rectangular, prismatic shape open on a large side and side walls surrounding the cavity and defining a periphery; (c) a resonator strip cutter system comprising a first resonator strip cutter, and optionally, one or more additional resonator strip cutters, for cutting elongated resonator strips sequentially from a supply of magnetostrictive amorphous metal alloy to an adjustable, preselected resonator strip cut length; (d) an extractor for extracting at least one of the resonator strips from the resonator cutter system and disposing the at least one resonator strip, and preferably two or more resonator strips in stacked registration, in each of the cavities to provide a magnetomechanical element; (e) an affixing system for affixing a lid to the periphery to close the cavity and contain the magnetomechanical element therewithin; and (f) a bias strip cutter for cutting bias strips from a supply of semi-hard magnetic material, and fixedly disposing at least one of the bias strips on the lid in registration with the magnetomechanical element to produce a non deactivatable marker.

Optionally, the press includes a heating means to preheat the cavity webstock prior to cavity formation.

The press may further comprise an activation magnet system comprising at least one activation magnet for activating at least some, and preferably all of the markers by magnetizing the bias strips, whereby the markers are armed to resonate at the marker resonant frequency.

In some implementations, the press also comprises an in-line frequency measurement and control system for adaptively adjusting the resonator strip cut length during fabrication of the sequence to match the marker resonant frequency to a preselected target resonant frequency. The system preferably comprises: (a) a measurement system comprising a transmitter for imposing a burst of electromagnetic field having substantially the target resonant frequency onto a preselected sample portion of markers of the sequence, the burst exciting the markers of the sample portion into magnetomechanical resonance, and a receiver for detecting the marker resonant frequency during a ringdown after the burst; and (b) a computing system connected to the receiver and the resonator cutter system, the computing system recording the marker resonant frequency for the markers of the sample portion, computing an updated resonator strip cut length based on a difference between the recorded marker resonant frequencies and the target resonant frequency, and causing adjustment of the resonator strip cut length to the updated resonator strip cut length for subsequently cut resonator strips to reduce the difference for subsequent markers of the sequence. Preferably, the activation system activates substantially all the markers produced by the press. Preferably, the sample portion comprises substantially all the markers within an interval of the sequence.

In still another aspect, there is provided an assemblage of a plurality of such magnetomechanical markers. The assemblage preferably is formed of markers produced in sequence using a supply of magnetostrictive amorphous metal alloy. In preferred embodiments the assemblage comprises a sequence of at least 2000 markers, which exhibit a narrow distribution of frequencies, preferably a distribution having a relative standard deviation of frequencies of markers no more than about 0.5% and, more preferably, no more than about 0.3%.

BRIEF DESCRIPTION OF THE DRAWINGS

The invention will be more fully understood and further advantages will become apparent when reference is had to the following detailed description of the preferred embodiments of the invention and the accompanying drawing, wherein like reference numerals denote similar elements throughout the several views, and in which.

DETAILED DESCRIPTION OF THE INVENTION

Figure 1:
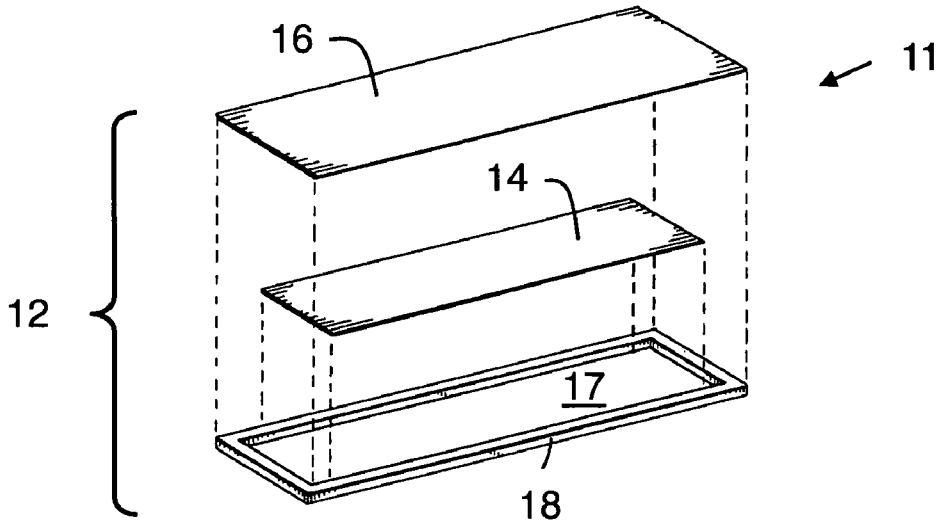
Fig. 1 (prior art)
FIG. 1 is an exploded, perspective view of a prior art EAS marker.
Figure 2:
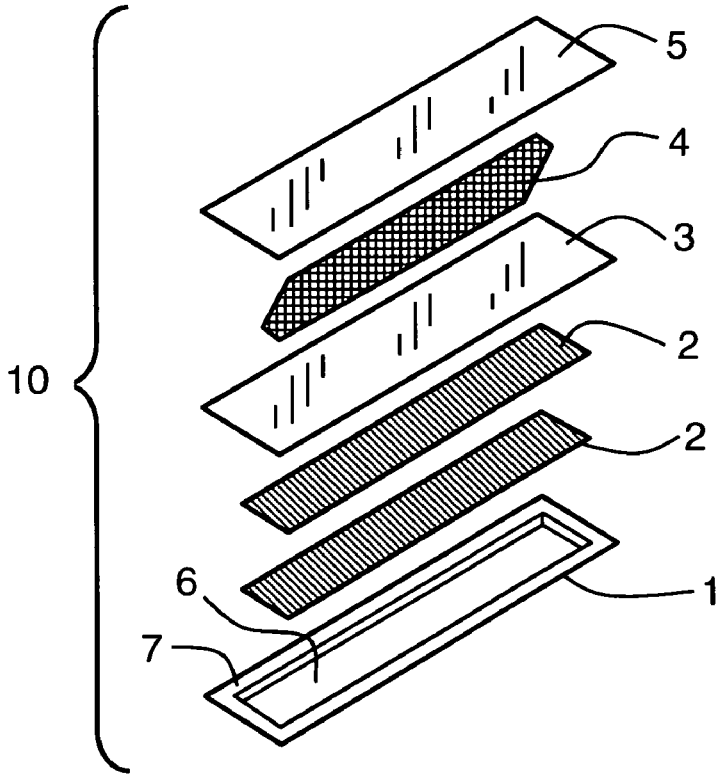
FIG. 2 is an exploded, perspective view of an EAS marker in accordance with the invention.
Figure 3:
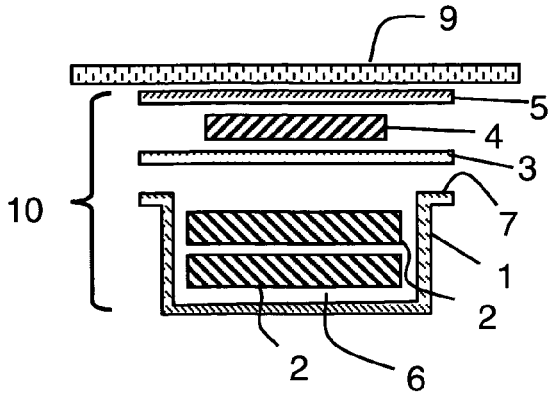
FIG. 3 is an end-on, cross-sectional view of the EAS marker of FIG. 3.
Figure 4:
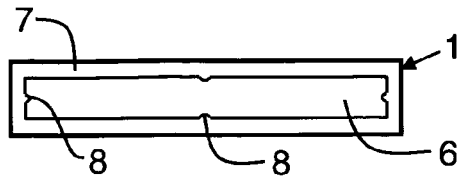
FIG. 4 is a plan view of one form of an EAS marker cavity of the invention.

In one aspect, the present invention provides a marker comprising a resonator element, a biasing magnet element, and associated structure to contain these elements. Referring now to FIGS. 2-4, the marker 10 in one implementation comprises a carrier 1 composed of sheet-form plastic material in which is formed an indentation or cavity 6 having the shape of a rectangular prism open on one of its large faces. Side walls surround the cavity and define a periphery. The indentation 6 is sized to accommodate a magnetomechanical element, such as two resonator strips 2 placed therein in stacked registration. Optionally, small projections 8 are molded into the long sides and/or ends of the cavity. Such projections facilitate centering the resonating strips in the cavity without unduly constraining them mechanically. Preferably, the periphery substantially surrounds the cavity on all four sides and is formed by lip 7. The internal thickness of the cavity is defined generally by the spacing between the plane of the bottom of the cavity 6 and the parallel plane of the surfaces of the lip 7. A closure, such as a layer of flat polymer sheet or lidstock 3, is placed over the indentation and sealed to lip 7 to encase the resonator strips 2 within cavity 6, while permitting the strips to mechanically vibrate freely. Preferably lidstock 3 is heat sealed to lip 7, although use of glue or other like adhesive agent, ultrasonic welding, or other attachment means is also contemplated. A bias element 4 is associated with the housing and separated from strips 2 but disposed in registration with them, as depicted. Element 4 is preferably in the form of a strip of semi-hard magnetic metallic alloy having a generally polygonal shape, such as a rectangle or the truncated acute-angle parallelogram shape depicted in FIG. 2. Optionally, a final layer 5 coated on both sides with a pressure-sensitive adhesive is applied to secure bias strip 4 and permit attachment of the marker, e.g. to a merchandise item. For convenience of automated manufacture, handling, distribution, and subsequent end use, the marker is removably attached by the adhesive on the exterior surface of layer 5 to a release liner 9.

The magnetomechanical element preferably consists essentially of two rectangular strips of an FeNiMoB-containing amorphous metal alloy. A suitable material is sold commercially as ribbon by Metglas, Inc., Conway, S.C., under the trade name METGLAS® 2826 MB3 and understood to have a nominal composition (atom percent) $Fe_{40}Ni_{38}Mo_4B_{18}$. The 2826MB3 alloy is a magnetostrictive, soft ferromagnetic material, having a saturation magnetostriction constant ($\lambda_s$) of about $12\times10^{-6}$, a saturation magnetization ($B_s$) of about 0.8 T, and a coercivity ($H_c$) of about 8 A/m (0.1 Oe). These resonator strips may used in the as-received condition from the manufacturer without being subjected to any heat-treatment. The resonating strips in a preferred implementation are about 6 mm wide and 38 mm long, resulting in acousto-magnetic resonance for an electromagnetic exciting frequency of about 56-60 kHz. Unannealed METGLAS® 2826 MB alloy is another suitable resonator material. In other embodiments, other suitable magnetostrictive, soft ferromagnetic materials may also be used as resonator elements, in either the heat-treated or as-received condition.

As used herein, the term "ribbon" denotes a generally thin, substantially planar material extending to an indeterminate length along a length direction, and having a width direction perpendicular to the length. The length and width define two opposed ribbon surfaces. The thickness is substantially less than the width or length dimensions. Amorphous metal is generally supplied commercially in the form of such ribbon wound onto spools that may contain many kilograms of material having a length of thousands of feet or more. As used herein, an "elongated strip" refers to a finite geometric form having a length greater than either a thickness or a width. The elongated strip of resonator material used in the EAS marker of the invention may have the form of a wire having approximately equal width and thickness, but preferably is a finite, generally rectangular portion of a ribbon having length greater than thickness. Preferably, the length of a strip used in the magnetomechanical element of the present marker is at least 100 times its thickness and at least five times its width. By "registration" is meant a relative orientation and positioning of multiple elements in a predetermined arrangement. "Stacked registration" refers to a disposition of two or more strips having substantially similar dimensions, the strips being arranged one over the other in substantial overlap, if not exact congruency, and with their ribbon surfaces generally parallel. In any event, the term is intended to preclude a side-by-side or other non-collinear arrangement. Those skilled in the art will recognize that an elongated strip as defined herein possesses a low demagnetizing factor for magnetization along the elongated direction.

The present marker is further provided with a bias means that provides a magnetic field to bias the magnetomechanical element and thereby activate it by arming the element to resonate at a marker resonant frequency. The bias means may comprise a bias element, such as one or more magnetized elements composed of permanent (hard) magnetic material or semi-hard magnetic material. By a "hard magnetic material" is meant a material having a coercivity in excess of about 500 Oe. By a "semi-hard magnetic material" is meant a material having a coercivity sufficient to prevent the label from being de-activated by an inadvertent alteration of its magnetic state by exposure to fields ordinarily encountered during handling, transportation, and use of the present marker. In accordance with the present invention, the label cannot be de-activated in the manner used for "deactivatable" markers presently in use in the market place. The markers cannot be demagnetized by apparatus conventionally used in connection with EAS markers, e.g. by exposure to an exponentially damped sinusoidal magnetic field that has an initial strength typically provided by such deactivation apparatus. Generally, a semi-hard material has a coercivity in the range of about 10-500 Oe. The present marker employs a bias element having a coercivity greater than that used in current markers. The coercivity level used in the present label will be above typically about 70 Oe. More preferably, the bias element has a coercivity greater than about 100 Oe. A wide variety of magnetic materials are thus suitable. In some applications, and in this embodiment the ordinary use of the marker does not entail any deactivation. In this situation, the bias element may employ a hard magnetic material, since there is no requirement that the bias element be demagnetizable in the field. High anisotropy, high coercivity materials, such as ferrites and rare-earth magnets, may be provided as magnets having a short aspect ratio, i.e., a low ratio of the dimensions along the magnetization direction and in a perpendicular direction. Semi-hard magnetic materials used in the bias elements, such as alloys sold under the tradenames Arnokrome, and other semi-hard steels, are advantageously employed as thin strips. Preferably, one of these semi-hard bias materials is used in the form of a single strip aligned generally parallel to the elongated magnetomechanical element. The bias strip may have a generally rectangular shape or may have any other polygonal but elongated shape, such as the truncated parallelogram shape of element 4 shown in the embodiment of FIG. 2. In some other implementations the bias means may comprise magnetized magnetic powder, such as barium ferrite, which may be dispersed within a polymeric matrix comprising part or all of the marker housing. Other representative embodiments employ bias magnets formed onto a sheet-form separator element, such as lidstock 3 of FIGS. 2-4, e.g. by painting or even printing a slurry of magnetic particles in a carrier or by printing using any suitable magnetic ink that provides the requisite bias flux to arm the magnetomechanical element and a suitably high coercivity so that the marker substantially resists inadvertent alteration of its magnetic state by exposure to fields ordinarily encountered during handling, transportation, and use thereof. Other forms by which the bias means may be incorporated in or on the housing to produce a marker that substantially resists deactivation will be apparent to persons skilled in the art.

A preferred semi-hard bias material is sold by Arnold Magnetics, Marengo, Ill. under the trade name ARNOKROME™ 3.

Another preferred bias material exhibiting similar physical and magnetic properties, including a coercivity of above 70 Oe and a flux of 400 to 500 nWb, is sold by Arnold Magnetics In a representative embodiment, the foregoing marker is used in conjunction with a pulsed, magnetomechanical EAS system that includes an apparatus that comprises a transmitter, a receiver, and one or more antennas in the form of loops of wire. Some or all of these system components are ordinarily disposed within one or more pedestals situated at a screening location, such as a retail store exit. The transmitter and receiver may share an antenna or use separate antennas. In operation, the transmitter generates a signal that is fed to a transmitting antenna to create an electromagnetic field having an interrogation frequency (often approximately 58 kHz) within an interrogation zone. During a transmit interval, the transmitter is gated on to produce an electromagnetic field that induces a magnetomechanical resonance at substantially the same frequency in the marker. The magnetomechanical element of the marker is urged to resonance during each pulse. After each pulse is completed, the energy stored in the magnetomechanically resonating element decays and as a result, the marker dipole field emanating from the marker decays or rings down correspondingly. The amplitude of the alternating field generally remains within an envelope that decays exponentially, affording the marker a signal-identifying characteristic that is detectable by the receiver. At a time subsequent to the transmit interval, the receiver is connected to a receiving antenna and gated on to receive a signal during a receive interval. The detection of this ring-down in synchrony with the activation of the marker by the interrogating field provides a preferred way of reliably discriminating the marker's response from other ambient electronic noise or the response of other nearby ferrous objects which are not resonantly excited. An indication means is operably associated with the receiver and is activated in response to the detection of the signal-identifying characteristic by the receiver. Articles to which the marker is attached thereby may be protected against shoplifting in a retail establishment. Typically, after the legitimate purchase of an item, the marker is either removed or the marker will be "passed through" out of the detection range of the system. Removal of the marker from an item of merchandise appointed for protection will permit the bearer and the item to pass through an interrogation zone at the store's exit without triggering the detection alarm.

It will be readily appreciated that the electronic article surveillance system and marker of the invention can be employed for related, yet diversified uses that can be accomplished by reliable and unambiguous detection of a marker associated with a person or object. For example, the marker can function as: (i) an identification badge for a person, e.g. for regulating access to a controlled area; (ii) a vehicle toll or access plate for actuation of automatic sentries associated with bridge crossings, parking facilities, industrial sites or recreational sites; (iii) an identifier for checkpoint control of classified documents, warehouse packages, library books, domestic animals, or the like; or (iv) a identifier for authentication of a product. Accordingly, the invention is intended to encompass those modifications of the preferred embodiment that allow recognition of any person or object appointed, by attachment or other suitable association of the marker, for detection by an electronic article (EAS) system. It is further intended that invention encompass the identification by an electronic article surveillance system of a person or animal bearing a marker provided in accordance with the invention. In this invention the biasing element having a higher coercivity level will make the marker feasible for the above references.

Figure 6:
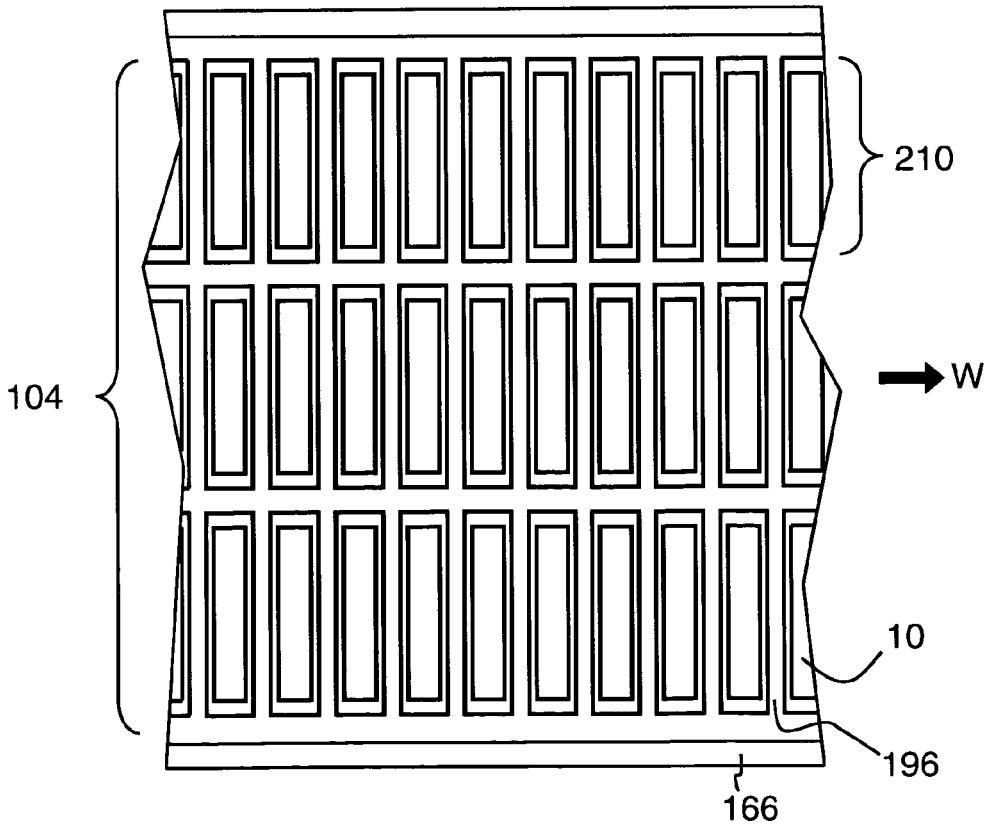
FIG. 6 is a broken, plan view of a portion of a web of markers during production in accordance with the invention.
Figure 5:
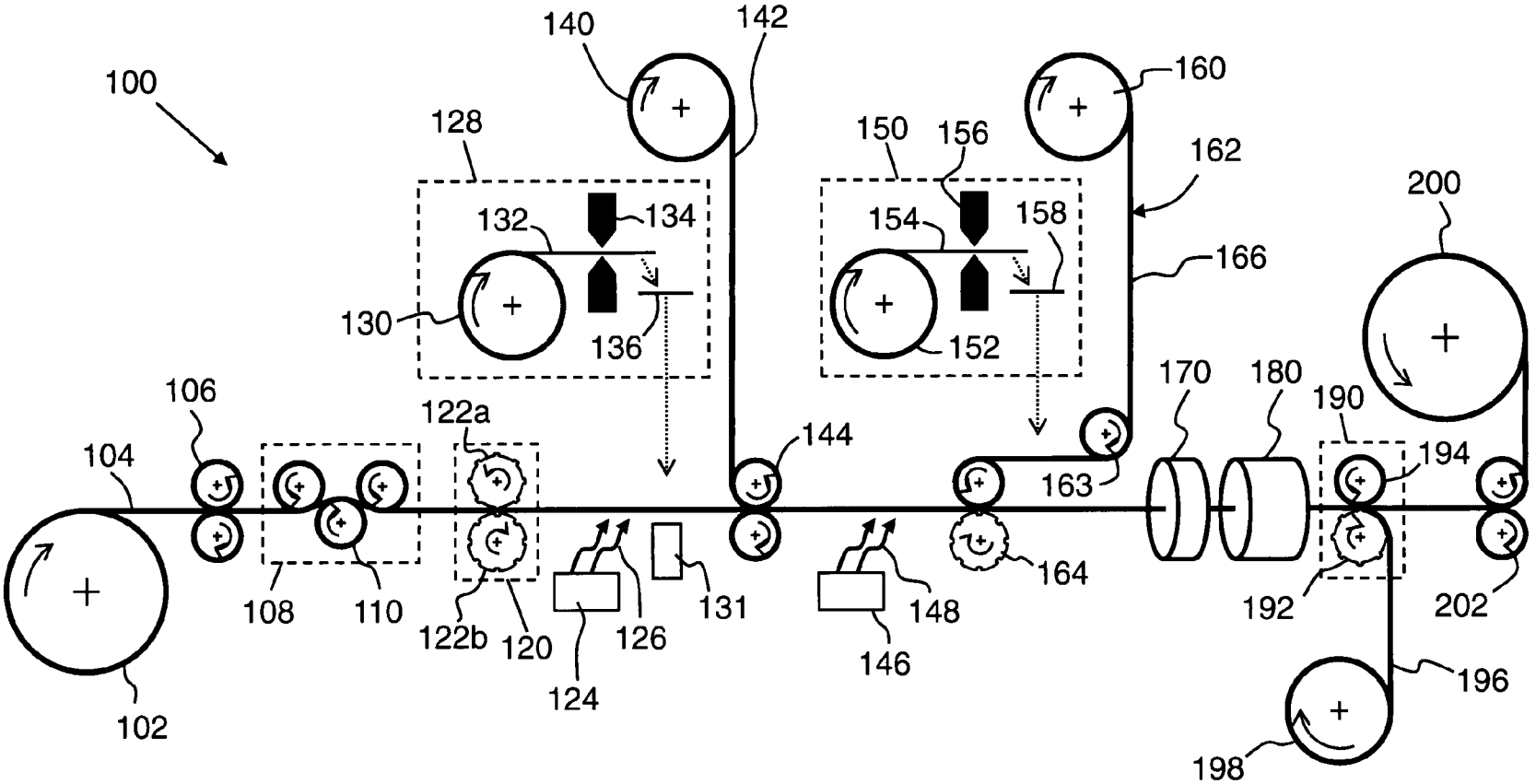
FIG. 5 is a schematic diagram in side elevation view of a process for continuously manufacturing magnetomechanical EAS markers in accordance with the invention.

In typical commercial practice, it is preferred that the markers 10 of the type depicted by FIGS. 2-4 be produced as a sequence in a continuous process using a press, as depicted generally at 100 by FIG. 5. A web 104 of cavity stock is delivered continuously from a roll 102 to the press infeed. Nip rollers 106 advance web 104 into the press. It will be understood that each of the various rolls and spools depicted by FIG. 5 rotates about its axis in a direction generally indicated by the respective arrows. As best seen in FIG. 6, markers 10 are formed in a sequence defined by embossing the required cavities in a column 210 extending along the length of the web (direction W of FIG. 6). The cavities preferably are oriented with their length direction across the web. The width of the web may include one or more columns, such as the three columns 210 of the FIG. 6 embodiment, with two to three columns being preferred. Web 104 then passes to preheating stage 108. Preferably the web traverses one or more heated rollers 110 in a labyrinthine pattern. The number of rollers, the extent of wrap, and the roller temperature are selected to heat the cavity stock to a temperature permitting it to be worked satisfactorily. For example, high impact polystyrene-polyethylene laminate (HIPS) cavity stock often used is preferably heated to a temperature of 250-350° F. Alternatively, the cavity stock might be heated by impingement of hot air or radiant heat onto the material. Cavity formation die set 120 is used to emboss the web 104. Preferably, cavity formation die set 120 comprises enmeshing male and female dies 122*a*, 122*b* having the requisite pattern to deform the heat-softened web, thereby producing thin cavities having a rectangular, prismatic shape open on one large side. First blower 124 provides a stream of air 126 directed at the web to cool it.

A resonator strip cutter system is used to cut elongated resonator strips from a supply of magnetostrictive amorphous metal alloy. In the implementation shown in FIG. 5, the resonant strip cutter system comprises a resonator strip cutter, such as cutter head 128. The system prepares the magnetomechanical element, which is comprised of one or more strips of magnetostrictive amorphous metal alloy supplied as a continuous ribbon 132 from amorphous metal supply spool 130. Ribbon 132 is advanced by a feed means, e.g. a nip roller pair (not shown) through shear blades 134, which operate to cut pieces 136 to a predetermined resonator strip length. The one or more pieces are then disposed in stacked registration within a cavity in the advancing, formed web of cavity stock. Preferably, the press includes an extractor used to extract resonator strips from the resonator strip cutter system. The extractor imposes a force on the resonator strips that directs them away from the cutter system and into the marker cavities. In preferred implementations, the extraction system may include an extractor magnet, such as permanent magnet 131 disposed on the side of the advancing web opposite the cutter head. Magnet 131 urges the one or more cut resonant strips into disposition in the respective cavities formed in the cavity stock. Use of such a magnet 131 helps to assure that the resonator strips are introduced fully into the open volume of the cavity in stacked registration and to prevent edges of the strips from hanging up on the cavity lip. Although FIG. 5 depicts a permanent magnet 131, it is to be understood that an electromagnet may also be used. An electromagnet may be operated either continuously, or in a pulsed mode synchronized to the forward motion of the webstock. The extractor system may also use other means, e.g. a pneumatic or vacuum system, to effect placement of the one or more resonant strips into the open cavity.

Lidstock supply spool 140 provides lidstock material 142 which is sealed to lips around each cavity to contain the magnetomechanical element in the cavity. Preferably, the sealing is accomplished by passing the web and applied lidstock through heated rollers 144. Flowing air 148 is then delivered from second blower 146 to cool the web after the sealing. One suitable lidstock material is polyethylene-polyester laminate. The lid material is preferably planar, but may also include other non-planar features providing the markers with improved end-use capabilities.

Bias cutter head 150 provides bias elements, such as magnet strips 158 which are cut by bias shears 156 from bias alloy ribbon 154 supplied from bias supply spool 152. Elements 158, which have a preselected bias element shape, are adhered onto one side of double sided tape 162 supplied from spool 160 and fed across idler roll 163. The side of tape 162 bearing elements 158 is then impressed onto the outside face of lidstock 142, e.g. by tape rollers 164, thereby securing element 158 in registration with the magnetomechanical element. The opposite side of tape 162 is preferably covered with a release liner, such as a liner composed of paper, a thin polyester, or other known release liner material. It is preferred that bias cutter head 150 include provision for adjusting bias shears 156 during machine setup or maintenance, or during production, to cut bias strips that have a preselected length and shape. Optionally, the adjustment of shears 156 is made adaptively under computer control to permit compensation for variation in the mechanical or magnetic properties of the bias material.

In the FIG. 5 implementation, the markers 10 are activated by passing them through activator station 170 which employs at least one activation magnet, which may be an electromagnet or permanent magnet (not shown), to impose a magnetic field on bias elements 158, preferably magnetizing them substantially to saturation. Resonant frequency detection system 180 then measures the natural resonant frequency of the markers 10. In other implementations of the present press and marker fabrication process, some or all of the markers are appointed to be activated later, e.g. prior to being affixed to merchandise articles at the facility of a customer or a supplier. In still other implementations, the bias elements are magnetized before being installed in the marker, eliminating the need to activate the markers after assembly.

Cutting/stripping station 190, which may employ a die cutter 192 engaging backing roller 194, die cuts each marker around its four-sided outline and through the cavity stock, lidstock, and doublesided tape, but leaving the release liner 166 intact. As best seen in FIG. 6, network 196 comprises that portion of the bonded cavity stock and lidstock between the edges of the markers in adjacent rows and columns. Network 196 is stripped from release liner 166 and received onto waste roll 198. In the implementation of press 100 seen in FIG. 5, stripping of network 196 is accomplished after activation. Alternatively, the stripping might be accomplished before activation. In some embodiments, the markers 10 are in abutting relationship without any extra spacing, eliminating network 196 and thus any need for its removal. Outfeed nip rollers 202 maintain tension on the advancing release layer, which bears the attached markers and is delivered onto rotating takeup spool 200.

In still other implementations, the markers are not cut during initial production. For example, the continuous web might be cut only at the point of being associated with merchandise by a supplier as part of a source tagging method. Such applications also may not require the marker to include an adhesive backing and release liner, if the marker is merely intended to be incorporated within merchandise packaging.

It will be understood that the various rollers, spools, and shears in apparatus 100 may be driven by any suitable prime movers, including electric motors of any suitable type, electromechanical actuators, hydraulic or pneumatic drives, or other like means. The relative speeds of the various drives may be established and regulated by electronic control, gearing, clutches, or the like. A suitably programmed PLC or general purpose computer is preferably used to control the entire press system. The inline measurement and control system may employ this computing means or a separate system. Tension control and suitably provided idler loops in the web feed path preferably are employed in a manner known to a person skilled in the art. The rollers may be smooth cylinders, but preferably are provided with suitable patterning or grooves such that pressure is applied principally to portions of the web outside the formed cavities, so that the internal shape of the cavity is not compromised or deformed in a manner that would impair free vibration of the magnetomechanical element during marker interrogation. It will also be understood that apparatus 100 may be appointed to simultaneously produce multiple columns of markers from the same feedstocks and attach them to a common release liner. For example, FIG. 6 illustrates three columns 210 on a common release liner 166. Such an implementation may employ ganged resonant and bias element cutting heads, one set being provided to produce the resonant and bias elements for each of the column. Alternatively, a single set of cutting heads may be used with suitable handling means to deliver the cut elements in turn to cavities in each column.

It will also be understood that the present invention may be practiced using different materials and production methods. For example, different materials may be used in a production process of the foregoing type and the various mechanical steps may be carried out in a difference sequence and with other suitable mechanical techniques. For example, vacuum formation might be effected in the cavity formation die system.

If it is desired to produce markers in other convenient forms of supply, the production method depicted by FIG. 5 may be modified to include further cutting or shearing operations, preferably downstream of the stripping operation at 190. For example, a release layer bearing multiple columns of markers may be slit longitudinally (i.e., along direction W in FIG. 6) to produce rolls with fewer columns or a single column. Alternatively, a shear or other suitable cutter may be used to shear the release layer transversely (i.e. in the plane direction perpendicular to W and optionally longitudinally as well) to provide individual, generally rectangular, sheets of activated markers bearing a desired number of rows and columns of markers. For end use, markers are typically removed from liner sheets 166 and affixed to items of merchandise or the like by the adhesive on the outward-facing side of layer 5. Adhesive on the inward-facing side secures the bias strip to the marker without contacting the magnetomechanical element. These operations may be carried out as part of the overall process 100, or they may be accomplished off-line using spools collected on takeup spool 200 and thereafter transferred to other machines adapted to provide spools or sheets of markers in a different configuration.

The components of the housing of the present marker are constructed of one or more suitable materials, such as rigid or semi-rigid plastic materials. The magnetomechanical element cavity may be formed by any suitable casting, molding, or machining technique that yields a chamber within which the magnetomechanical element is permitted to vibrate freely. Preferably, the forming method is suited to high-speed, continuous production in an in-line press. Embossing, vacuum and injection forming, molding and cylinder compression are especially suited. In other implementations, suitably shaped cavities to house the magnetomechanical element my be formed by folding a flat material. While the bias element in the embodiment of FIGS. 2-5 is secured by tape, the marker might also include an additional cavity appointed to accommodate one or more bias magnets. The housing also may be provided with apertures or other structures (not shown) facilitating attachment of the marker to an appointed item. For example, a rivet, screw, lanyard, or adhesive may be used for the attachment.

The present techniques are beneficially used in conjunction with Retailer tagging, by which is meant a business practice in which a Retailer that has goods that require a security marker with the goods, e.g. by placing the marker within or on the packaging during residence thereof at the retail store. In certain aspects of the invention parts or all of the housing may be integrally formed in packaging, e.g. that used for an article of commerce. In some embodiments, the packaging of the merchandise is provided with internal or eternal structures to accommodate the marker. The location of such structures may intentionally be made inconspicuous or not. Alternatively, the marker may be recycled for use later on other products or thrown away. Some such implementations do not require external adhesive.

The continuous marker process of FIG. 5 preferably employs feedback or other similar adaptive control, by which the natural resonant frequency of the markers can be matched much more closely to a preselected target marker resonant frequency than has been possible heretofore.

In particular, the inventors have found, surprisingly and unexpectedly, that markers employing plural, unannealed amorphous metal resonator strips can be fabricated while maintaining the resonant frequency within tight limits and providing high characteristic signal output. By way of contrast, it previously was believed that unannealed ribbon could not be used in this manner to obtain a high production yield. Of course, the present adaptive feedback control is also beneficially employed in manufacturing markers employing a single unannealed resonator strip or single or multiple annealed resonator strips.

In order to limit false alarms triggered by extraneous ambient electronic noise, magnetomechanical EAS receivers typically use a narrow bandpass delimited by suitable digital or analog input filtering. Accordingly, these receivers are responsive only to markers having a resonance within a relatively narrow range of frequencies. For example, known magnetomechanical EAS systems may operate at a target frequency of about 58 kHz with a bandwidth of ±300 Hz. Ideal methods of producing markers must therefore be highly robust, maintaining a high yield of markers providing, in combination, a resonance falling within a narrow bandwidth and a high output amplitude. These characteristic improve the selectivity of the EAS detection process and the pick rate, i.e. the probability that an activated marker present in the interrogation zone is successfully detected. Ideally, even tighter control would be desired and would to permit the input bandwidth to be further restricted.

A tighter resonant frequency distribution provides a further benefit during operation of an EAS system, because it facilitates reliable detection.

Implementations of the present production technique providing markers with a tighter distribution of resonant frequencies about a target frequency permit an EAS detection system to recognize a smaller frequency shift as indicative of deactivation. More specifically, prior art production may be capable of ensuring that all markers have a resonant frequency between $F_r-\Delta F_r$ and $F_r+\Delta F_r$. Any marker having a frequency outside this interval may be regarded as deactivated. On the other hand, an improved process will ensure that all active markers have resonant frequency between $F_r-\Delta f_r$ and $F_r+\Delta f_r$, wherein $\Delta f_r<\Delta F_r$.

An EAS system designed for the new markers could then operate with a tighter input filtering and discrimination. A prior art system had to regard any marker with a resonant frequency between $F_r-\Delta F_r$ and $F_r+\Delta F_r$ as being a valid, active marker. Moreover, prior art systems required that deactivation shift the resonant frequency to a value outside this range. By way of contrast, markers produced in accordance with the present invention do not undergo deactivation. The reduction of bandwidth decreases the sensitivity of the receiver to ambient electronic noise, improving the system's discrimination between noise and actual active marker signals. The use of a marker resistive to deactivation, and the procedure for removal of the markers virtually eliminate the advent of false alarms. These advantageous features of the markers are highly sought in the marketplace.

However, known production processes typically are not capable of continuously producing markers with resonant frequencies as closely controlled as would be desirable. Production lots are found to include markers characterized by a wide statistical distribution of natural resonant frequencies, resulting in the need for extensive quality control testing to weed out markers not having a resonant frequency within requisite limits. Such inspection itself is fraught with problems and results in reduced production efficiency and the need to discard large numbers of unusable markers. Recycling these defective markers in an environmentally acceptable way is quite difficult. Of necessity, the marker packaging must generally be strong to resist tampering by would-be thieves in a store. The markers contain several incompatible materials, commingling both two different metallic materials and disparate plastics and other organics. Although it would be particularly desirable to recycle the relatively expensive magnetic metal materials, removal of the adjacent plastic and organic materials is needed to minimize unacceptable contamination. Manufacturing processes that minimize the need to discard off-frequency markers are thus strongly sought.

Previous attempts to tighten the resonant frequency distribution during marker production have taken various approaches, including: (i) annealing the magnetomechanical element material to regularize its critical properties and reduce the inherent variation thereof (see, e.g., the '563 patent); (ii) using feedback control of the annealing process, based solely on measurements of the properties of the magnetostrictive strip (see, e.g., the '563 patent); and (iii) adjusting the magnetization state of the bias magnet of each marker after it is produced to shift the resonance to within tolerable limits (see, e.g., the '230 patent). In addition, attempts have been made to adjust the length of cut resonator strips based on measurement of the resonance under bias provided by an externally imposed magnetic field, e.g. a field provided by electromagnets. None of these approaches has proven fully satisfactory for high-volume production. Moreover, adjusting the magnetization of the bias magnet is typically more difficult for the high coercivity bias element used in the present marker.

Without being bound by any particular theory, it is believed that several sources contribute to the ultimate variability of the marker resonant frequency, including the properties of both magnetic materials (the resonant strip and the bias magnet) and details of marker construction, such as the precise relative placement of the magnetomechanical element and the bias magnet. Equation (1) above indicates that the resonant frequency $f_r$ is affected by both the sample length L and the effective Young's modulus E. It has been found that the physical variation in length L of the resonant strip attainable in known cutting processes is too small to account for the observed variation in frequency $f_r$, so that other effects, including material variability and field-dependent changes that are manifest in variations in the effective value of E are apparently operative. These frequency variation problems are found to be exacerbated in markers wherein the magnetomechanical element comprises plural strips of amorphous magnetic material. Both the magnetostrictive and bias magnetic materials used in magnetomechanical EAS markers are typically supplied as spools or reels containing indefinite amounts of material in ribbon form and having the requisite width. Each spool may contain sufficient material to produce hundreds or thousands of actual markers. Variations in the magnetic materials are believed to exist both between spools of the same nominal material and within a given spool. The operative magnetic properties of a given section of material depend on plural factors, including inter alia ribbon thickness, composition, physical and surface condition, and heat treatment details. Variations within a given reel may represent changes that occur either gradually through a reel or on a length scale more commensurate with the length of each individual piece that is cut from a longer reel. All of these variations alter the effective value of E and thus change the marker resonant frequency, even though the lengths of marker elements are cut to tight tolerances. Off-line adjustment before a full production run can somewhat compensate for inter-reel variations, but result in significant waste of material and inefficient production. Correcting for either slow or rapid intra-reel variations presents a far greater challenge.

On the other hand, the present inventors have discovered an adaptive, feedback-driven process that can reduce the variability of markers produced in a production sequence to a level that renders the process economically and industrially viable. Moreover, such a process is sufficiently robust to permit unannealed resonator element material to be used in multi-element markers, for which previous processes have not been capable.

More specifically, a feedback technique based on in-line measurement and control of the resonant frequency of actual markers provides a process that is far more robust than any process which relies solely on off-line measurement of the resonant frequency of strips exposed to a well-defined, externally imposed biasing magnetic field, e.g. a field produced by solenoidal electromagnets. Such an off-line process at best can partially compensate for variations, but only in the properties of the resonant material itself. By way of contrast, the present in-line, adaptive process can compensate for changes in both the resonator material, the bias material, and the finished marker configuration. Specifically, the in-line process can address subtle variations in the bias field that arise either from changes in inherent physical properties, geometric changes in the markers, or differences in the magnetization achieved during activation of the markers. Measurement and control using the actual marker resonance instead of simply the resonance of isolated amorphous metal resonator strips permits compensation for all these effects. The result is a more robust process that is more efficient and cost-effective, both in material usage and production yield.

In preferred implementations, the present press and production method permit fabrication of markers in which the relative standard deviation of resonant frequency is no more than about 0.5%, and more preferably, no more than about 0.3%.

A further benefit of some implementations of the present adaptive control system is the ability to rapidly adjust the system after supply reels of the magnetostrictive and bias materials are changed during extended production. It is found that each new reel of material requires slight adjustment of resonator strip cut length to attain the desired resonant frequency. The present system allows these accommodations to be made quickly and with minimal loss of yield at startup.

In addition, the present process obviates the need for functional testing of markers subsequent to production, since such testing is inherently accomplished during production, eliminating the need for the multiple testing steps previously employed. The present process is even seen to be capable of controlling production of markers employing a magnetomechanical element with multiple, unannealed strips to produce acceptably low variation. On the other hand, the prior art, such as the '563 patent, has taught markers with multiple stacked resonating strips that are producible only with annealed material. Beneficially, unannealed amorphous magnetic material is easier to handle and cut than annealed material, which is often found to be brittle and difficult to cut reliably and cleanly. Cracks and other similar microstructural defects often result from cutting and/or slitting annealed ribbon. Such defects can alter the effective length of the ribbon, drastically shifting its resonant frequency, and can also reduce the mechanical Q of the resonance, thereby degrading the output amplitude, often to the point of rendering a particular marker undetectable. Elimination of the annealing step, previously regarded as needed to reduce the inherent variability of as-cast amorphous magnetic material to acceptable levels, thus simplifies production, increases reliability, and reduces cost. Still further, dual-strip EAS marker embodiments provided by the '563 patent disclose only cobalt-containing amorphous metals, which have higher raw materials cost than the Co-free alloys that are employed in preferred implementations of the present process.

The present feedback-driven length adjustment provides for adjustment of the resonator strip cut length based on measurement of the resonant frequency of a sample portion of one or more markers previously made and activated in a production sequence. That is to say, the length $L_i$ of the one or more resonant strips in the i-th marker produced in a sequence is based on the measurement of the natural marker resonant frequencies of a preselected sample portion of a preselected sample of previous markers of the sequence, such as the frequencies $f_{rj}$ to $f_{rk}$ of the j-th through k-th markers, respectively, wherein $j \leqq k < i$. For example, the preselected markers may comprise an uninterrupted sequence of every marker within a production interval, or a subset thereof. Preferably, $j \neq k$, that is to say, the measurement of more than one previous marker is used in the corrective adjustment. The adjustment may be made based on an average of the marker resonant frequencies of any suitable number of previous markers, such as 10 to 1000 previous markers. Preferably, the adjustment is based on an average of the frequencies of about 50 to 500 previous markers. More preferably, the measurement is based on a weighted or moving average. Most preferably, the measurement is based on an exponentially declining moving average, which puts greater statistical weight on results from more recently produced markers. However, any other appropriate statistical averaging and correction may also be applied. It is preferred that measurement of marker resonant frequency be carried out on at least a sizeable fraction of the markers being produced, if not substantially all the markers. It is further preferred that any lag between measurement and correction be minimized. That is to say, it is preferable that the correction of resonant element cut length be based on the most recently produced markers, which corresponds to having the value of k be as close as possible to the value of i. Of course, markers of the sample portion must be activated prior to measurement of their natural resonant frequencies.

The correction of resonant element cut length is based on the difference between the actually observed resonant frequencies of the markers of the sample portion and a preselected target marker resonant frequency. Typically the fractional adjustment of length for future markers in a sequence is inversely proportional to the fractional deviation in actual frequency from the aim of the immediately preceding markers, the deviation being calculated using the selected form of averaging. The use of averaging techniques improves the closed-loop stability of the present feedback process. It will be understood that after initial start-up and stabilization, the needed adjustments are ordinarily quite small, so that even with the foregoing adjustment, the resonant element cut lengths of all the elements fabricated in a production sequence are substantially the same, by which is meant the lengths are sufficiently close to permit all the markers of a production sequence to resonate at a frequency of about the target, deviating by no more than about the desired input bandwidth of the EAS receiver with which the markers are to be used.

Figure 7A:
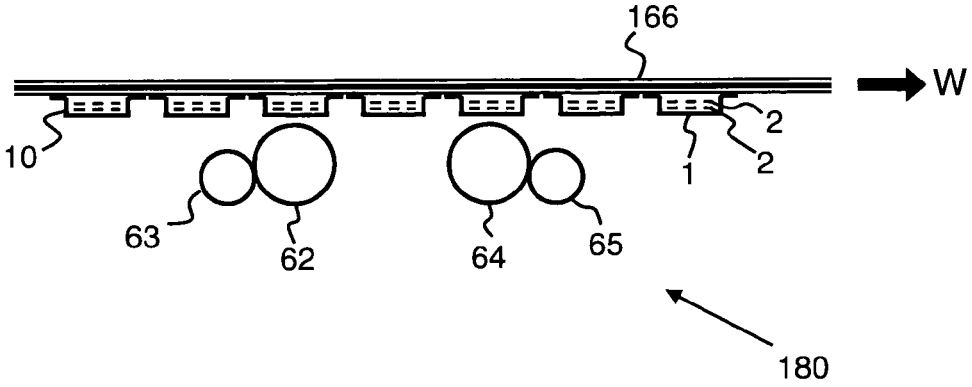
FIGS. 7A and 7B are schematic diagrams in side elevation view and bottom plan view, respectively, of a detection system used in production of EAS markers in accordance with the invention.
Figure 7B:
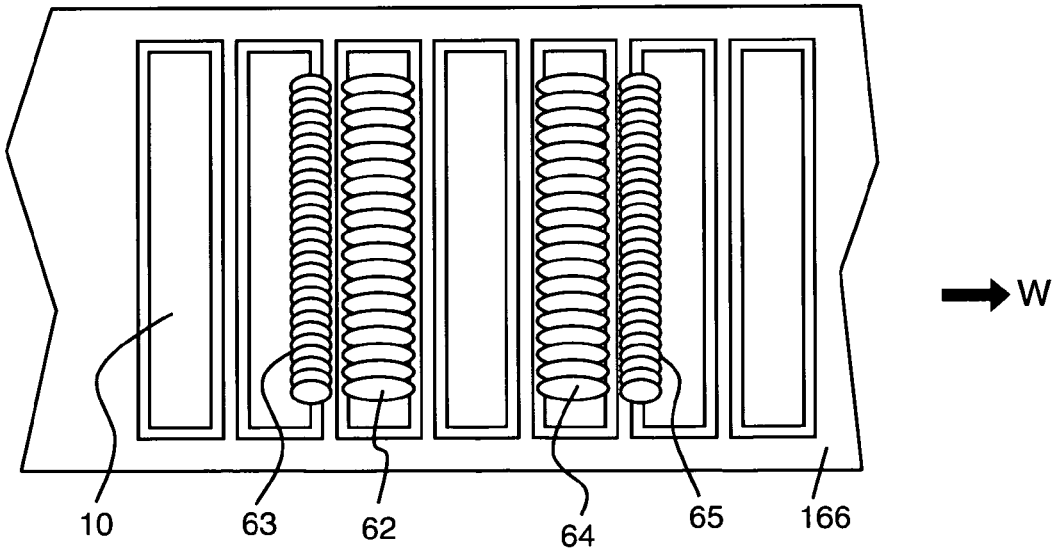

One implementation of the feedback system employs the detection system shown generally at 180 by FIGS. 5 and 7A-7B. Markers 10 carried by release liner 166 are moved through press 100 in the web direction generally indicated by arrow W. The markers pass sequentially over transmitter coil 62 and receiver coil 64. Transmitter and receiver null coils 63 and 65 are used to minimize interference. Alternatively, one or more pieces of a highly permeable magnetic shielding material, such as a soft ferrite or mu metal may replace null coils 63 and 65. Transmitter coil 62 provides a burst of electromagnetic field at approximately the desired marker resonant frequency, thereby urging strips 2 in each marker in proximity to coil 62 into magnetomechanical resonance. Thereafter, the markers pass out of the vicinity of transmitter coil 62 but into the vicinity of receiver coil 64. The resonant elements remain in vibration at their natural resonance. The separation of coils 62 and 64 is selected such that the decaying amplitude of magnetomechanical resonance is still adequate to permit a signal to be detected when the element reaches coil 64.

Some implementations of the feedback measurement system employ a single coil that is switched between connection to the transmitter and receiver. That is to say, the coil is first connected to the transmitter during the duration of the transmitted electromagnetic field burst and thereafter connected to the receiver to receive the field emitted by the resonant element during the ringdown of its mechanical vibration. A single-coil system optionally includes magnetic shielding elements to reduce interference. Both single and multiple coil systems might include an idler loop for the marker web so that the forward motion of the portion of the web bearing the marker being tested can be arrested in the vicinity of the coil system for the brief interval required for excitation and ringdown of that marker. Alternatively, the testing is carried out rapidly enough that a given marker under test remains within the range of the coil system for long enough to be excited and the ringdown sensed, despite its progress through the press.

In a preferred implementation depicted by FIGS. 7A-7B, coils 62-64 are located below the traversing web and in close proximity thereto. Coils 62-64 are operated using a measurement system comprising suitable electronics (not shown) under the control of software and/or hardware operating in a computer system, such as a general purpose computer, programmed logic controller, or other suitable computer control means. The computer system ascertains the frequency of the voltage induced in coil 62. The control system also provides the required buffering and computations of an updated resonator strip cut length. The computer system also is interfaced with cutter head 128 and causes subsequent strips to be cut to the updated resonator strip cut length. The measurement and adjustment steps are carried out repeatedly during the production process.

The efficacy of the present control system may be measured using any appropriate statistical metric characterizing the width of a distribution. Most commonly, a conventionally calculated standard deviation of the measured marker resonant frequencies is used, and may be specified as a relative standard deviation, i.e., a ratio of the standard deviation of the measured frequencies to the mean marker resonant frequency of the sample population.

It will be understood that in some implementations, parallel columns of targets are produced on a single advancing web, with each column being supplied with its magnetic elements from different feed spools that are cut by different cutter heads. In such implementations, it is preferred that a suitable detection system 180 be provided for each column, so that the resonant strip cut lengths can be independently selected and adjusted for each column.

The principles of the present adaptive technique can also be employed to produce coded markers, in which each marker comprises a plurality of strips resonant at different preselected frequencies. Such a system might be implemented either with multiple transmit and receive coils, in which each set is devoted to measurements for a particular one of the different resonant frequencies. Alternatively, a single set might be used for a sequence of multiple excitations. In either case, the one or more cutter heads used can be controlled to produce strips having different resonant frequencies, the various lengths being adaptively controlled such that each of the multiple frequencies is within tight limits.

The following examples are provided to more completely describe the properties of the component described herein. The specific techniques, conditions, materials, proportions and reported data set forth to illustrate the principles and practice of the invention are exemplary only and should not be construed as limiting the scope of the invention.

EXAMPLE 1

Short Duration Marker Production and Testing

A series of magnetomechanical EAS labels having a natural resonant frequency for magnetomechanical oscillation are produced using a continuous-feed, web-based press. Each label comprises a housing having a cavity, two resonator strips disposed in the cavity to form a magnetomechanical element, and a bias magnet adjacent the resonator strips. The production is accomplished using a press adapted to carry out, in sequence, the following steps: (i) embossing cavities in a high-impact polystyrene-polyethylene laminate webstock material; (ii) cutting magnetostrictive amorphous metal ribbon stock using a resonator strip cutter system to form resonator strips having a preselected resonator strip length; (iii) extracting two of the resonator strips from the cutter system; (iv) disposing the extracted strips in each cavity in stacked registration; (v) covering and sealing each cavity with a lidstock material that confines the resonator strips in the cavity without constraining their ability to vibrate mechanically; (vi) cutting semi-hard magnetic material to form bias magnet strips having a preselected bias strip length; (vii) placing and securing a bias magnet strip on the lidstock proximate the resonator strips; and (viii) activating the EAS label by magnetizing the bias magnet strip substantially to saturation. The press is capable of operating in two different modes: (i) a fixed-length mode, in which the preselected resonator strip length is set to a fixed value; or (ii) an adaptive, feedback driven mode in which the resonator strip cut length is adaptively adjusted to maintain a preselected target resonant frequency, which is chosen to be about 58 kHz.

The feedback system employs an in-line measurement and control system that includes a transmitter coil that provides a gated burst of electromagnetic field applied to the labels in the production stream. After each burst, the natural magneto-mechanical resonance of a particular marker is detected generally as a sinusoidal voltage induced in a receiving coil, the voltage having an exponentially decaying amplitude. The free oscillation frequency corresponds to the natural magneto-mechanical resonance frequency of that label. The system employs an electronic measurement system, preferably one based on a general-purpose computer programmed to continuously accumulate, in a first-in, first out buffer, the resonant frequencies of the labels in the production. A buffer size of 300 measurements (about 1 minute's worth of production) is chosen as a sample portion, and the average resonant frequency and standard deviation are calculated using the computer. In feedback mode, if the average frequency deviates by more than a preselected amount from the target frequency, the computer directs the cutting head to cut subsequent resonator strips to an updated cut length to compensate for the deviation and bring the frequency back into range. In particular, the system is programmed to increase/decrease the nominal cut length by 0.002 inches if the frequency is more than 50 Hz higher/lower than a nominal target, e.g. 58,050 Hz.

A production run is carried out to yield the results set forth in Table I hereinbelow, in which is set forth the nominal resonator cut length, the average and standard deviation of the resonant frequency of a 300-label buffer at the indicated time during the run. These data are collected on labels made using resonator strips cut from a single supply lot of METGLAS® 2826 MB magnetostrictive amorphous metal and bias strips cut from a single supply lot of ARNOKROME™ 4 semi-hard magnet material.

TABLE I

Production Statistics For EAS Label Fabrication

| time (min.) | feedback mode (on/off) | nominal length (inches) | average frequency (Hz) | standard deviation (Hz) |
|---|---|---|---|---|
| 0 | off | 1.495 | 58490 | 291 |
| 1 | off | 1.495 | 58482 | 292 |
| 2 | off | 1.495 | 58476 | 291 |
| 3 | off | 1.495 | 58472 | 291 |
| 4 | off | 1.495 | 58472 | 285 |
| 5 | off | 1.495 | 58477 | 271 |
| 6 | off | 1.495 | 58496 | 270 |
| 7 | off | 1.495 | 58481 | 284 |
| 8 | off | 1.495 | 58485 | 293 |
| 9 | off | 1.495 | 58490 | 284 |
| 10 | off | 1.495 | 58484 | 286 |
| 11 | off | 1.495 | 58477 | 292 |
| 12 | on | 1.497 | 58474 | 285 |
| 13 | on | 1.497 | 58441 | 281 |
| 14 | on | 1.499 | 58442 | 257 |
| 15 | on | 1.499 | 58443 | 248 |
| 16 | on | 1.501 | 58423 | 241 |
| 17 | on | 1.501 | 58414 | 229 |
| 18 | on | 1.503 | 58390 | 248 |
| 19 | on | 1.503 | 58360 | 251 |
| 20 | on | 1.505 | 58325 | 227 |
| 21 | on | 1.505 | 58295 | 231 |
| 22 | on | 1.507 | 58261 | 216 |
| 23 | on | 1.507 | 58244 | 214 |
| 24 | on | 1.509 | 58211 | 221 |

TABLE I-continued

Production Statistics For EAS Label Fabrication

| time (min.) | feedback mode (on/off) | nominal length (inches) | average frequency (Hz) | standard deviation (Hz) |
|---|---|---|---|---|
| 25 | on | 1.509 | 58190 | 223 |
| 26 | on | 1.511 | 58159 | 219 |
| 27 | on | 1.511 | 58134 | 222 |
| 28 | on | 1.513 | 58108 | 220 |
| 29 | on | 1.513 | 58091 | 215 |
| 30 | on | 1.513 | 58074 | 223 |
| 31 | on | 1.513 | 58062 | 228 |
| 32 | on | 1.513 | 58045 | 232 |
| 33 | on | 1.513 | 58036 | 234 |
| 34 | on | 1.513 | 58036 | 225 |
| 35 | on | 1.513 | 58031 | 224 |
| 36 | on | 1.513 | 58025 | 228 |
| 37 | on | 1.513 | 58015 | 219 |
| 38 | on | 1.513 | 57993 | 253 |
| 39 | on | 1.513 | 57990 | 250 |
| 40 | on | 1.511 | 57988 | 250 |
| 41 | on | 1.511 | 57988 | 211 |
| 42 | on | 1.511 | 58009 | 222 |
| 43 | on | 1.511 | 58017 | 237 |
| 44 | on | 1.511 | 58018 | 245 |
| 45 | on | 1.511 | 58023 | 248 |

It is seen that after the adaptive feedback system is activated at about 12 minutes into the production run, the system senses the deviation from the target 58,050 Hz resonant frequency and begins making adjustments to the cut length that rapidly brings the observed average resonance into a close match to the desired target frequency, with a relatively small standard deviation within each buffer size.

EXAMPLE 2

Extended Duration Marker Production and Testing

The efficacy of the adaptive feedback label production system used for the experiments of Example 1 is tested during extended duration production. The system is operated in a normal factory production schedule to produce labels using the same nominal resonator and bias materials employed in Example 1. However, multiple supply lots are used over several days' worth of production. The press is operated for several days each without and with use of the adaptive resonator strip length control. Results are set forth in Table II below.

TABLE II

Production Statistics For EAS Label Fabrication

| Run No. | feedback mode (on/off) | average frequency (Hz) | standard deviation (Hz) |
|---|---|---|---|
| A1 | off | 58096 | 634 |
| B1 | off | 58087 | 733 |
| A2 | on | 58067 | 273 |
| B2 | on | 58055 | 336 |

Although Runs A1 and B1 both achieve an average resonant frequency close to the desired 58050 Hz value, the standard deviation over the production run of over 1,000,000 markers is substantially larger than the standard deviations attained in runs A2 and B2 made with the adaptive feedback system engaged.

EXAMPLE 3

Extended Duration Marker Production and Testing

An implementation of the present marker fabrication press and process employing an extractor using a permanent magnet disposed below the traversing webstock is used for high-rate production of markers. The markers are formed using METGLAS® 2826 MB3 resonator strips and ARNOKROME™ 5 semi-hard magnet alloy strips as bias elements. An in-line frequency measurement and control system is used to adaptively adjust the resonator strip cut length during fabrication of a sequence of markers. The measurement system includes a single coil used for both transmit and receive functions, the coil being electrically switched under computer control between transmitter circuitry during pulse excitation of the marker under test and receiver circuitry to sense the subsequent resonant ringdown of the marker. Alternate markers in the production sequence are thus tested.

The efficacy of the adaptive feedback label production system in maintaining a tight distribution of resonant frequencies in the production sequence is indicated by the data of Table II set forth below. From each lot a group of ten markers is randomly selected as being representative. The resonant frequency and ringdown behavior of each marker are tested using an off-line tester. The average values of frequency, amplitude immediately after the cessation of the exciting pulse (V0) and after a 1 ms ringdown interval (V1) are tested. A standard deviation of the frequency values is calculated.

TABLE III

Production Statistics For EAS Label Fabrication Lots (average values)

| Lot No. | V0 (volts) | V1 (volts) | average frequency (Hz) | Standard deviation (Hz) | relative std. dev. (%) |
|---|---|---|---|---|---|
| 10 | 0.221 | 0.127 | 58022 | 171 | 0.29 |
| 11 | 0.110 | 0.062 | 58066 | 164 | 0.28 |
| 12 | 0.169 | 0.109 | 58043 | 125 | 0.22 |

All of the markers exhibit satisfactory behavior, permitting them to be used in a magnetomechanical EAS system operating at a nominal 58 kHz exciting frequency. The markers exhibit a relative standard deviation of resonant frequency well below 0.3%.

Having thus described the invention in rather full detail, it will be understood that such detail need not be strictly adhered to, but that additional changes and modifications may suggest themselves to one skilled in the art, all falling within the scope of the invention as defined by the subjoined claims.

What is claimed is:

1. A process for fabricating a sequence of non-deactivatable magneto-mechanical EAS markers, each marker having a marker resonant frequency, the process comprising:

a. forming a plurality of cavities along a web of cavity stock, each of said cavities having a substantially rectangular, prismatic shape open on a large side and a lip extending substantially around the periphery of said opening of said cavity;

b. cutting elongated resonator strips sequentially from a supply of magnetostrictive amorphous metal alloy using a resonator strip cutter system, said resonator strips having a resonator strip cut length;

c. extracting at least one of said resonator strips from said resonator strip cutter system using an extractor that imposes a force on said resonator strips that that directs them away from said resonator strip cutter system and into said cavities;

d. disposing at least one of said resonator strips in each of said cavities to provide a magnetomechanical element of said marker;

e. affixing a lid to said lip to close said cavity and contain said magnetomechanical element therewithin;

f. supplying bias elements from a supply of hard or semi-hard magnetic material;

g. fixedly disposing a said bias element on said lid in registration with said magnetomechanical element;

h. activating at least a portion of said markers by magnetizing said bias elements, whereby said activated markers are armed to resonate at said marker resonant frequency;

i. measuring said marker resonant frequency of each of the markers in a preselected sample portion of said sequence, the markers of said sample portion having been activated in step (h);

j. adaptively controlling said resonator strip cut length for resonator strips incorporated in subsequently produced markers of said sequence, said resonator strip cut length being adjusted to an updated resonator strip cut length determined from a difference between said measured marker resonant frequencies and a preselected target resonant frequency, whereby said difference for said subsequently produced markers is reduced; and k. repeating steps (i) and (j) through the course of said fabrication.

2. A process as recited by claim 1, further comprising cutting said web to separate said markers.

3. A process as recited by claim 1, wherein said resonator strips are unannealed.

4. A process as recited by claim 1, wherein said cut markers are adhered to a release liner.

5. A process as recited by claim 1, wherein said magnetomechanical element consists essentially of a plurality of said strips in stacked registration.

6. A process as recited by claim 1, wherein said magnetomechanical element consists essentially of two of said strips in stacked registration.

7. A process as recited by claim 1, wherein said resonator strip cutter system comprises a plural number of resonator strip cutters, each of said cutters having a supply of magnetostrictive amorphous metal alloy, and said magnetomechanical element comprises said plural number of strips, one of said strips being supplied from each of said resonator strip cutters.

8. A process as recited by claim 1, wherein said bias element comprises at least one bias strip of a semi-hard magnetic material having a coercivity level higher then 70 Oe.

9. A process as recited by claim 1, wherein said sample portion comprises substantially all the markers within an interval of said sequence.

10. A process as recited by claim 1, wherein said updated resonator strip cut length is determined from an average of said measured marker resonant frequencies of said markers of said sample portion.

11. A process as recited by claim 10, wherein said average is a weighted, moving average.

12. A process as recited by claim 1, wherein said extractor comprises an extraction magnet.

13. A process as recited by claim 1, capable of producing an assemblage comprising at least 2000 markers produced substantially in sequence, the markers of said assemblage exhibiting a relative standard deviation of marker resonant frequency of no more than about 0.3%.

* * * * *